United States Patent [19]

Selonke et al.

[11] 3,952,854

[45] Apr. 27, 1976

[54] APPARATUS FOR DIRECT AND CIRCUITOUS TRANSPORT OF CIGARETTES OR THE LIKE FROM MANUFACTURING TO PROCESSING MACHINES

[75] Inventors: Fritz Selonke; Ulrich Bornfleth, both of Hamburg, Germany

[73] Assignee: Hauni-Werke Korber & Co., KG, Hamburg-Bergedorf, Germany

[22] Filed: Sept. 25, 1974

[21] Appl. No.: 509,123

[30] Foreign Application Priority Data

Sept. 27, 1973 Germany ..... 2348597

[52] U.S. Cl. ..... 198/20 C; 198/34

[51] Int. Cl.[2] ..... B65G 47/24

[58] Field of Search ..... 198/20 C, 235, 34, 31, 198/32, 39

[56] References Cited

UNITED STATES PATENTS

| | | | |
|---|---|---|---|
| 3,365,857 | 1/1968 | Liedtke | 198/34 |
| 3,854,567 | 12/1974 | Poupin et al. | 198/20 C |

*Primary Examiner*—James B. Marbert

*Attorney, Agent, or Firm*—Peter K. Kontler; John Kurucz

[57] ABSTRACT

Apparatus for regulating the movement of cigarettes from a maker to a packing machine has a first multi-conveyor transporting unit which normally delivers cigarettes directly to a bin for the block forming device at the inlet of the packing machine, and a second multi-conveyor transporting unit which can deliver cigarettes to the last conveyor of the first unit in response to actuation of a switchover device. The latter normally transfers cigarettes from the maker to the first conveyor of the first unit but is caused to transfer cigarettes to the first conveyor of the second unit in response to detection of a pile-up of cigarettes on an intermediate conveyor of the first unit. The path which is defined by the second unit communicates with the interior of a variable-volume magazine which can accept cigarettes, whereby its volume automatically increases, when the packing machine is slowed down or arrested while the maker continues to supply cigarettes at a normal rate. The magazine discharges cigarettes into the path, and its volume thereby automatically decreases, when the packing machine operates normally but the maker is slowed down or arrested. The discharge end of the path is normally blocked by a conveyor which allows cigarettes to leave the path and to reach the last conveyor of the first unit in response to detected depletion of the supply of cigarettes in the bin. The maker and the packing machine are automatically arrested when the volume of the magazine respectively increases to a maximum value and decreases to a minimum value.

45 Claims, 3 Drawing Figures

APPARATUS FOR DIRECT AND CIRCUITOUS TRANSPORT OF CIGARETTES OR THE LIKE FROM MANUFACTURING TO PROCESSING MACHINES

BACKGROUND OF THE INVENTION

The present invention relates to apparatus for effecting and regulating the delivery of rod-shaped articles from a source which supplies articles at a variable rate to a consumer which accepts and processes articles at a variable rate, particularly to apparatus for effecting and regulating the delivery of filter rod sections or plain or filter-tipped cigarettes, cigarillos or cigars from a producing machine or maker to a processing machine or consumer, for example, to a packing, tray filling, pneumatic conveying, filter cigarette making or like machine. Still more particularly, the invention relates to improvements in apparatus for direct and indirect or circuitous transport of cigarettes or other rod-shaped smokers' products from a source to a consumer, especially from a manufacturing machine to a processing machine. For the sake of simplicity, the apparatus will be described in connection with the transport of cigarettes or filter cigarettes; it will be understood, however, that the apparatus can be used with equal advantage for the transport of other rod-shaped articles which are being produced and/or treated in tobacco processing plants.

It is already known to install a magazine between a producing machine or maker (e.g., a filter cigarette making machine) and a processing machine or consumer (e.g., a packing machine) which latter is directly coupled to the maker. As a rule, cigarettes which are supplied by the maker enter and travel through the magazine on their way to the consumer. The capacity of the magazine is such that it can accept and store the output of the maker for a certain interval of time while the consumer is out of commission or is slowed down or arrested for another reason. Inversely, the magazine supplies cigarettes to the consumer for a certain interval of time when the consumer is in operation but the maker is out of commission or is slowed down or arrested for another reason.

German patent No. 1,532,271 discloses a magazine for cigarettes or the like which is open at the top so that cigarettes can enter its interior by gravity and come to rest on the uppermost layer of cigarettes in the magazine. Such magazines are not entirely satisfactory because the cigarettes are likely to be damaged or deformed during entry into the magazine and/or to become misaligned so that they cannot be properly evacuated for transport to the consumer.

German Offenlegungsschrift No. 1,957,002 discloses a modified magazine which receives cigarettes from below. This reduces the likelihood of misalignment; however, the cigarettes are more likely to be deformed or destroyed, especially if the magazine already contains a substantial supply of cigarettes whose weight rests on the freshly admitted cigarettes. The liklihood of deformation of cigarettes is also pronounced immediately prior to introduction into the lowermost zone of the magazine because the cigarettes must be advanced with a considerable force in order to displace the cigarettes in the magazine during entry into the lowermost region of the stack of cigarettes therein.

All presently known variable-volume magazines for cigarettes share the disadvantage that they receive, at least temporarily, each and every cigarette which is being supplied by the maker. Thus, a cigarette must enter the inlet of the magazine and must be discharged by way of the outlet in order to be capable of reaching the consumer. Such mode of transport lengthens the path along which the cigarettes travel from the maker to the consumer and increases the likelihood of changes in moisture content, deformation, loss of tobacco shreds and/or other damage. During travel through the magazine, a cigarette is subjected to rather pronounced mechanical stresses which contribute to the loss of tobacco shreds and often result in such deformation of cigarettes that they cannot be properly processed in the consumer, particularly in a packing machine. Many magazines for temporary storage of cigarettes are designed in such a way that the cigarettes which are being conveyed therethrough travel along a meandering path; this necessitates the use of complex conveyor systems, guides, rollers and other components and contributes significantly to the liklihood of damage and/or deformation.

SUMMARY OF THE INVENTION

An object of the invention is to provide a novel and improved apparatus for transporting cigarettes or analogous rod-shaped articles from a maker or another source to a consumer in such a way that the liklihood of deformation of and/or damage to the articles which is much less pronounced than in heretofore known apparatus, which occupies little room, which can be installed between existing makers and consumers of rod-shaped articles of the tobacco processing industry, and which can be operated automatically so that the transport of articles between the maker and the consumer is not dependent on the skill, vigilance, presence and/or conscientiousness of attendants.

Another object of the invention is to provide an apparatus for effecting and regulating the delivery of rod-shaped articles from a source (e.g., a filter cigarette making machine or another maker) to a consumer (e.g., a packing machine or a tray filling machine) which is constructed and assembled in such a way that it automatically compensates for eventual deviations of the rate at which the source supplies articles from the rate at which the consumer accepts and processes the articles and which, though having a variable-volume magazine, is constructed and assembled in such a way that the articles are caused to enter the magazine only when the rate at which the source supplies articles exceeds the rate at which the consumer is capable of accepting articles.

A further object of the invention is to provide an apparatus which is at least as versatile as heretofore known apparatus but is capable of transporting the entire output or the major part of the output of a maker directly to a consumer so that such major part of the output need not even approach and/or temporarily dwell in the interior of the magazine.

The invention is embodied in an apparatus for effecting and regulating the delivery of rod-shaped articles (e.g., filter cigarettes of unit length) from a source (e.g., a producing machine such as a filter cigarette making machine) which supplies articles at a first variable rate to a consumer (e.g., a packing machine) which accepts articles at a second variable rate. The term "variable rate" is intended to embrace gradual changes in the output of a maker or in the quantity of articles which are being processed by a consumer as well as abrupt changes from normal rate to zero rate, or vice versa.

The improved apparatus comprises first transporting means for moving articles from the source directly to the consumer (preferably sideways and along a first path which is normally the shortest path between the source and the consumer), second transporting means for moving articles from the source to the consumer along a second path (e.g., along an inverted U-shaped or V-shaped path one end of which is adjacent to the source and the other end of which is adjacent to a portion of the first path), switchover means which may comprise one or more rotary or other types of conveyors and is actuatable to direct articles from the source into a selected path, a variable-volume magazine whose interior communicates with a portion of the second path (preferably with an intermediate portion of the second path), and means for changing the volume of the magazine in response to changes in proportion of the first and second rates so that the volume of the magazine increases (and the magazine receives articles from the second path) when the first rate exceeds the second rate (e.g., when the consumer is operated at less than normal speed or is arrested while the source continues to supply articles at a maximum rate) and that the volume of the magazine decreases (whereby the magazine feeds articles into the second path) when the second rate exceeds the first rate (e.g., when the consumer is operated at normal speed but the source supplies articles at less than maximum rate or ceases the delivery of articles.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
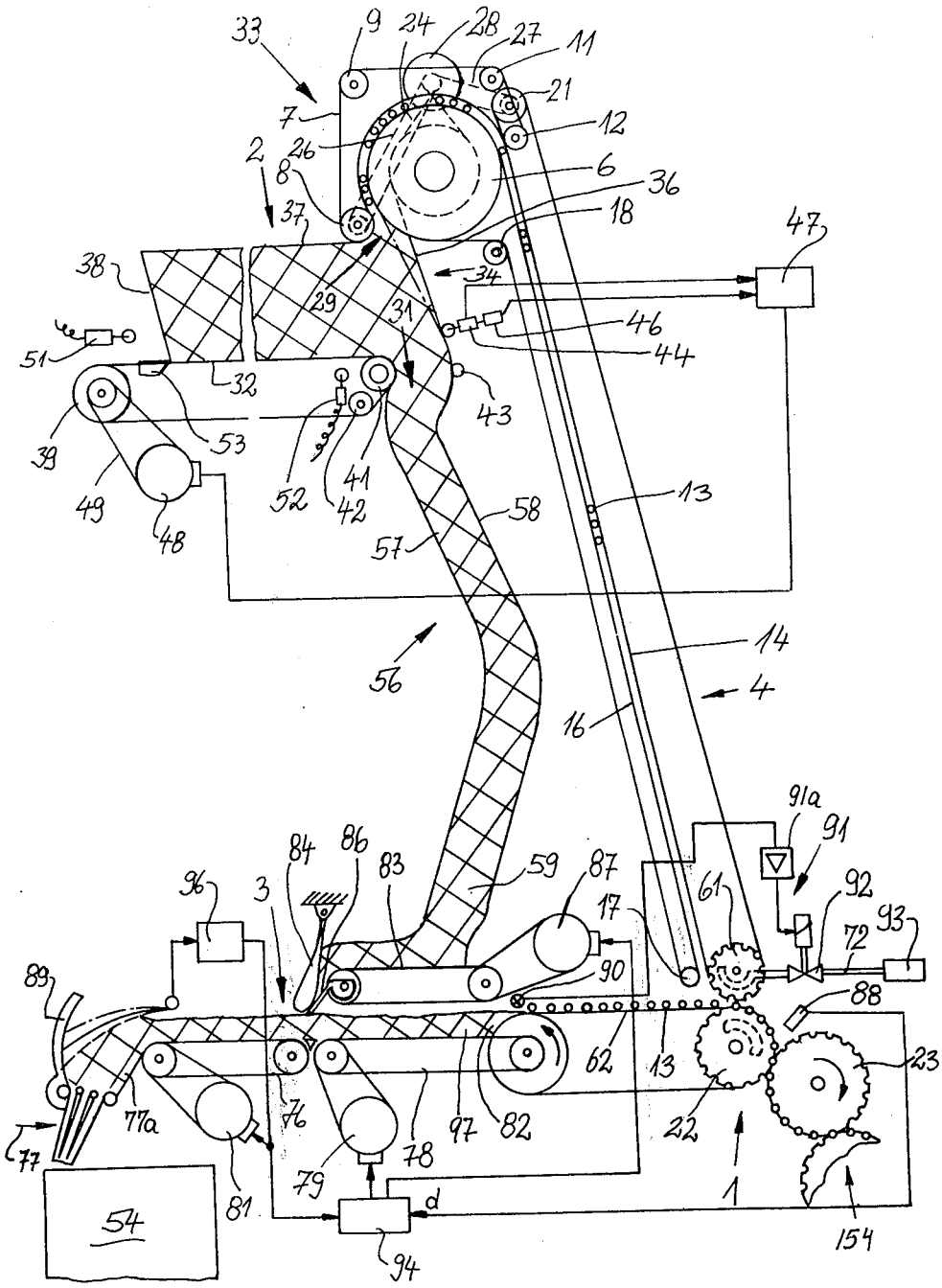
FIG. 1 is a fragmentary schematic partly elevational and partly vertical sectional view of an apparatus which embodies the invention.

The apparatus of FIG. 1 serves to effect and regulate the delivery of filter cigarettes 13 of unit length from a maker or source 154 having a rotary drum-shaped transfer conveyor 23 to a consumer 54, for example, a packing machine. The apparatus comprises a first or main transporting unit 3 which serves to move cigarettes 13 directly from the transfer conveyor 23 of the source 154 (e.g., a filter cigarette making machine) to the inlet of the packing machine 54 along a substantially straight first path, a magazine 2 which serves for temporary storage of cigarettes, and a second transfer unit 4, 33, 56 which serves to move cigarettes along an inverted U-shaped or V-shaped second path extending from the transfer conveyor 23, adjacent to the magazine 2 and to a portion of the first path which is defined by the main transporting unit 3. Still further, the apparatus comprises a switchover unit 1 which normally directs cigarettes 13 from the transfer conveyor 23 onto the first conveyor of the main transporting unit 3 but can be actuated to direct cigarettes 13 into a lifting device 4 which forms a first or foremost part of the second transporting unit. The latter further comprises a last part here shown as a chute 56 which can discharge cigarettes 13 onto a portion of the main transporting unit 3.

When the switchover unit 1 is actuated and causes cigarettes 13 to travel from the transfer conveyor 23 toward the magazine 2, such cigarettes move upwardly to a level above the magazine and thereupon downwardly to enter an inlet 29 of the magazine. The outlet 31 of the magazine 2 is located substantially or exactly below the inlet 29 and admits cigarettes into the upper end of the chute 56.

That portion of the second transporting unit which moves cigarettes 13 from the transfer conveyor 23 toward the inlet 29 of the magazine 2 comprises a plurality of conveyors including a rotary drum 6 which is located at a level above the inlet 29. This drum is driven to rotate in a counterclockwise direction, as viewed in FIG. 1. The drum 6 cooperates with two spaced apart endless belt conveyors 7 which define an arcuate portion of the second path for cigarettes 13, and the discharge end of this arcuate portion of the second path is located at the inlet 29 of the magazine 2. The belt conveyors 7 (only one shown in FIG. 1) are trained over a pair of driven pulleys 8, two additional pulleys 9 which are located at a level above the pulleys 8, and pairs of pulleys 11 and 12 which are located to the right of the pulleys 9, as viewed in FIG. 1. The belts 7 cooperate with the drum 6 to engage the end portions of cigarettes 13 in the arcuate portion of the second path, preferably in a manner as disclosed in the commonly owned copending application Ser. No. 373,663 filed June 26, 1973 by Bornfleth et al.

The lifting device 4 of the second transporting unit moves cigarettes 13 sideways from the transfer conveyor 23 of the source 154 into the arcuate portion of the second path between the drum 6 and the belt conveyors 7. This lifting device comprises two endless belt conveyors 14 and two endless belt conveyors 16 (only one of the conveyors 14 and 16 is shown in FIG. 1). The neighboring stretches of the belt conveyors 14 and 16 travel vertically or nearly vertically upwardly, as viewed in FIG. 1, and define an elongated straight portion of the second path which merges into the aforementioned arcuate portion of the second path between the drum 6 and belt conveyors 7. The belt conveyors 16 are trained over a pair of pulleys 17 located adjacent to the switchover device 1, over two additional pulleys 18 at a level below the drum 6, and over the drum 6. The belt conveyors 14 are trained over a rotary drum-shaped suction conveyor 61 which is adjacent to the transfer conveyor 23 and forms part of the switchover unit 1, and over two pulleys 21 which are located between the pulleys 11 and 12 for the belt conveyor 7.

The switchover unit 1 further comprises a second rotary drum-shaped suction conveyor 22 which can move cigarettes from the transfer conveyor 23 of the source 154 into the flutes 64 of the conveyor 61 or onto a first conveyor (including two endless belt conveyors 62) of the main transporting unit 3.

The means for driving the drum 6 comprises an electric motor 28 having an output shaft which transmits motion to an endless chain or belt 24 trained over a pulley or sprocket wheel which is coaxial with the drum 6. The motor 28 further drives the pulleys 8 for the belt conveyors 7 through the medium of an endless belt or chain 26, and the pulleys 21 for the belt conveyors 14 through the medium of an endless belt chain 27.

The construction of the magazine 2 is similar to that of the magazine which is disclosed in the commonly owned copending application Ser. No. 369,954 filed June 14, 1973 by Bornfleth et. al. The magazine 2 comprises a mobile bottom wall which is the upper stretch of an endless belt conveyor 32 trained over pulleys 39 and 41. The pulley 41 is adjacent to the outlet 31 of the magazine 2. The drum 6 and the belt conveyors 7 constitute a device (numbered 33) which forms part of the second transporting unit and serves to feed cigarettes 13 sideways into the inlet 29 of the magazine 2. The lowermost part of the arcuate portion of the second path defined by the drum 6 and belt conveyors 7 slopes slightly to the right, as viewed in FIG. 1, so that each cigarette 13 which enters the inlet 29 has a component of movement in a direction to the right and therefore tends to pivot a plate-like end wall 36 of the magazine 2. This end wall forms part of a detector 34 which further includes two limit switches 44 and 46. The pivot for the lower end portion of the end wall 36 is shown at 43; this pivot is located opposite the pulley 41 for the belt conveyor 32.

The magazine 2 further comprises a top wall 27 which extends to the left from the lowermost portions of the driven pulleys 8 for the belt conveyors 7. Still further, the magazine 2 comprises a movable end wall 38 which is located opposite the end wall 36 and is connected to the upper stretch of the belt conveyor 32. The capacity or volume of the magazine 2 can be changed by setting the belt conveyor 32 in motion so as to move the end wall 38 toward or away from the end wall 36.

The belt conveyor 32 is further trained over two idler pulleys 42 which are located below the pulley 41. The pulley 39 is driven by a rotary electromagnet 48 through the medium of an endless belt or chain 49. The electromagnet 48 can rotate the pulley 39 in a clockwise or counterclockwise direction. It is clear that the magazine 2 preferably further comprises at least one additional (front or rear) wall which is parallel to the plane of FIG. 1 and need not move with the upper stretch of the belt conveyor 32 and/or with the end wall 38. A relatively weak spring (for example, a torsion spring) is preferably provided to bias the pivotable end wall 36 of the magazine 2 in a counterclockwise direction, as viewed in FIG. 1. The upper end portion of the end wall 36 extends into a centrally located circumferential groove which is machined into the core of the drum 6 between the endless belt conveyors 7.

The limit switches 44, 46 of the detector 34 transmit signals to the corresponding inputs of a proximity detector 47 here shown as an electronic relay which can transmit signals for energization of the rotary electromagnet 48 to thereby control the direction of rotation of the pulley 39 for the endless belt conveyor 32 and end wall 38. A further limit switch 51 is mounted at the outer side of the movable end wall 38. When the end wall 38 engages a movable portion of the limit switch 51, the latter produces a signal which arrests the rotary electromagnet 48 and the drive means for the transfer conveyor 23 and other moving parts of the source 154. An additional limit switch 52 is installed at a level below the upper stretch of the endless belt conveyor 32 and can be actuated by a trip 53 on the upper stretch of the conveyor 32 to thereby produce a signal which arrests the rotary electromagnet 48 and the moving parts of the packing machine 54. It will be seen that the limit switch 51 produces a signal when the volume of the magazine 2 has risen to a maximum permissible value, and at the limit switch 52 produces a signal when the volume of the magazine 2 has been reduced to a minimum permissible value, i.e., when the movable end wall 38 is nearest to the other end wall 36 of the magazine 2. It is clear that the packing machine 54 constitutes but one of various consumers which can process the output of the source 154. It is further clear that a filter cigarette making machine (154) is but one of various sources which can supply cigarettes to the main transporting unit 3 or to the second transporting unit including the lifting device 4, the feeding device 33 and the chute 56.

The chute 56 comprises two elongated side walls 57 and 58 which define an elongated channel wherein the cigarettes 13 can descend in the form of a relatively wide column to be evacuated through the discharge end 59 of the chute 56 or to be temporarily intercepted by a blocking conveyor 83 in cooperation with a downwardly inclined ramp 86 and a depending pivotable gate 84. The channel which is defined by the side walls 57 and 58 is preferably V-shaped so that cigarettes 13 which descend in the chute 56 have a horizontal and a vertical component of movement during travel from the outlet 31 of the magazine 2 toward the discharge end 59 of the chute 56 and onto the upper stretch of the blocking conveyor 83. The cigarettes in the chute 56 descend by gravity and also under the weight of the column of cigarettes thereabove. The upper stretch of the blocking conveyor 83 defines a third path which is parallel or substantially parallel to a portion of the first path (above a conveyor 76 of the first transporting unit 3) and along which the cigarettes 13 must travel on their way from the discharge end 59 of the chute 56 into the first path.

Figure 2:
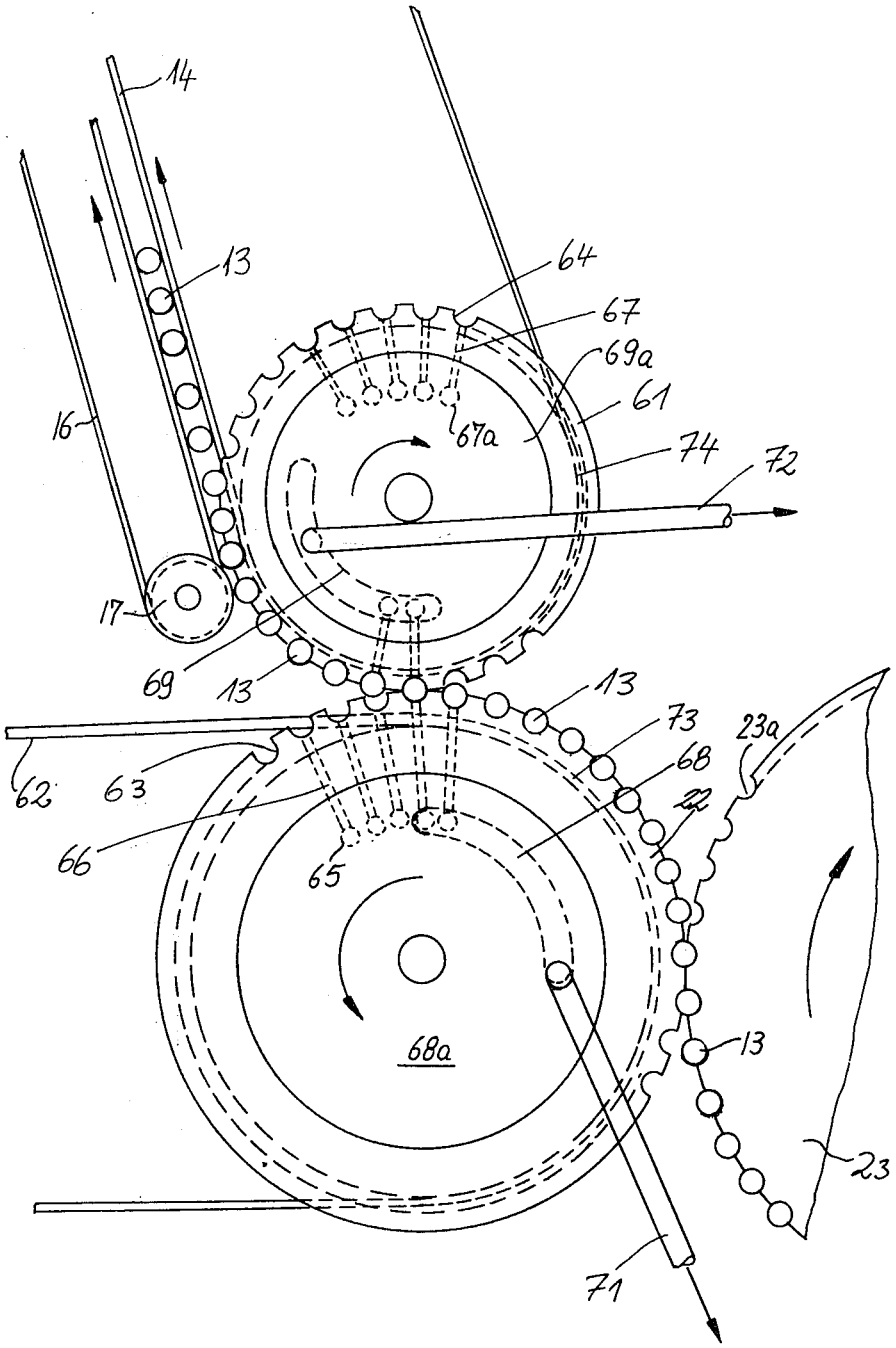
FIG. 2 is an enlarged elevational view of the switchover means in the apparatus of FIG. 1.

The switchover unit 1 comprises the aforementioned rotary drum-shaped suction conveyors 22 and 61. The conveyor 22 normally directs cigarettes 13 into the adjacent end of the first path defined by the main transporting unit 3, and the conveyor 61 can be actuated to direct cigarettes 13 into the adjacent end of the second path defined by the second transporting unit. As shown in FIG. 2, the conveyors 61 and 22 are respectively provided with cigarette receiving means in the form of flutes 64, 63 which are parallel to the axes of the conveyors and are bounded by concave surfaces. The means for retaining cigarettes 13 in the flutes 64 of the conveyor 61 comprises radial ports 67 which extend between the deepmost portions of the respective flutes 64 and axially parallel blind bores or channels **67*a* machined into the body of the conveyor 61 and terminating at the front end face of this body, as viewed in FIGS. 1 or 2. This front end face of the body of the conveyor 61 is adjacent to a stationary valve plate 69*a* having an arcuate groove 69 which extends from the locus of transfer of cigarettes 13 from the conveyor 22 to the conveyor 61 to the locus of transfer of cigarettes 13 into the adjacent end of the second path defined by the transporting unit 4, 33, 56, i.e., to the locus where the flutes 64 deliver successive filter cigarettes 13 into the elongated first portion of the second path between the neighboring stretches of the endless belt conveyors 14 and 16. The groove 69 of the valve plate 69*a*** is connected to a suction generating device 93 (see FIG. 1) by a suction pipe 72 which contains a normally closed shutoff valve 92.

The flutes 63 of the suction conveyor 22 communicate with radially inwardly extending suction ports 66 each of which further communicates with one of a plurality of axially parallel channels or blind bores 65 machined in the body of the conveyor 22. The open ends of the channels 65 are adjacent to the front end face of the body of the conveyor 22, as viewed in FIG. 2, and can communicate with an arcuate groove 68 machined into the inner side of a stationary valve plate 68*a*. The groove 68 communicates with a suction generating device (for example, with the device 93 of FIG. 1) by way of a suction pipe 71. As shown in FIG. 2, the groove 68 extends from the locus where the flutes 63 receive cigarettes 13 from the flutes 23*a* of the transfer conveyor 23 to the aforementioned locus where the groove 69 begins. This last mentioned locus is adjacent to or coincides with the transfer station or locus where the flutes 63 of the conveyor 22 normally deliver cigarettes 13 onto the upper stretches of the endless belt conveyors 62 constituting the first conveyor of the main transporting unit 3. The groove 68 of the valve plate 68*a* remains connected to the respective suction generating device as long as the transfer conveyor 23 delivers cigarettes 13 into the flutes 63. The shutoff valve 92 in the suction pipe 72 is opened only when the switchover unit 1 is to be actuated in order to direct cigarettes 13 into the elongated portion of the second path between the conveyors 14 and 16 of the lifting device 4.

FIG. 2 further shows one of two circumferential guide grooves 74 which are machined into the periphery of the conveyor 61 and serve to receive the lower end portions of the endless belt conveyors 14. The depth of the grooves 74 is such that the portions of belt conveyors 14 therein cannot interfere with the transfer of cigarettes from the flutes 63 into the flutes 64, i.e., the outer sides of such portions of the conveyors 14 are located inwardly of the flutes 64, as considered in the radial direction of the conveyor 61. Analogously, the median portion of the periphery of the conveyor 22 is formed with two circumferentially complete guide grooves 73 which receive the right-hand end portions of the belt conveyor 62, and the depth of the grooves 73 is sufficient to insure that the conveyors 62 cannot interfere with the transfer of cigarettes 13 from the flutes 23*a* of the transfer conveyor 23 into the flutes 63 and thereupon with the flutes 63 from the conveyor 23 toward the transfer station between the conveyors 22, 61 or onto the upper stretches of the belt conveyors 62. The planes of the guide grooves 74 and 73 are respectively normal to the flutes 64 and 63.

The distance between the two belt conveyors 14 and 16 is such that these conveyors engage only the end portions of filter cigarettes 13. Reference may be had to the aforementioned copending application Ser. No. 373,663. This also applies for the belt conveyors 62.

In addition to the first conveyor (including the two endless belt conveyors 62, the main transporting unit 3 further comprises two additional conveyors including an intermediate conveyor 78 and the aforementioned (last) conveyor 76. The upper stretch or stretches of the conveyor 78 can receive cigarettes from the upper stretches of the conveyors 62, and the upper stretch or stretches of the conveyor 76 can receive cigarettes from the upper stretch or stretches of the conveyor 78. The discharge end of the last conveyor 76 of the main transporting unit 3 delivers cigarettes 13 sideways into a bin 77*a* above the inlet of the packing machine 54. The bin 77*a* has a cigarette discharging portion 77 which constitutes a block forming device of known design. If the cigarettes 13 are to be assembled into groups or blocks of twenty cigarettes each, the block forming device 77 preferably comprises three downwardly inclined ducts each of which contains a single column of cigarettes 13. An intermittently movable pusher is caused to enter the ducts of the block forming device 77 at predetermined intervals to expel therefrom an array of twenty cigarettes in the customary formation including two outermost layers of seven cigarettes each and a median layer of six cigarettes which are staggered with respect to cigarettes of the outer layers. The packing machine 54 is assumed to be of the type which provides each group of cigarettes with an inner envelope consisting of a metallic foil, an outer envelope consisting of cardboard or flexible paper (depending upon whether the packs which are formed in the machine 54 are so-called soft or flip-top packs) and a customary revenue label. Cigarettes 13 which leave the bin 77*a* enter the ducts of the block forming device 77 by gravity and travel sideways.

The conveyors 62, 78, 76 of the main transporting unit 3 receive motion from separate drives. Thus, the endless belts of the conveyor 62 are driven by the conveyor 22 of the switchover unit 1, the intermediate conveyor 78 is driven by a motor 79, and the last conveyor 76 is driven by a motor 81. The speed of the conveyor including the endless belts 62 exceeds the speed of the intermediate conveyor 78 so that the cigarettes 13 which leave the conveyor belts 62 to descend onto the upper stretch or stretches of the conveyor 78 form thereon a multi-layer stream 97. The speed of the last conveyor 76 may equal or approximate the speed of the intermediate conveyor 78 and blocking conveyor 83. The transfer station between the conveyors 62 and 78 is shown as 82.

The blocking conveyor 83 is normally idle. This conveyor can be driven by a motor 87 at or close to the speed of the conveyor 76. The ramp 86 is pivotable about the axis of the left-hand pulley for the blocking conveyor 83, and its lower end portion normally rests on the topmost layer of the stream 97 of cigarettes 13 on the conveyors 78 and 76. The gate 84 normally abuts against the left-hand side of the ramp 86 to thereby intercept the cigarettes which tend to leave the upper stretch of the blocking conveyor 83 to descend onto the topmost layer of the stream 97.

The means for regulating the operation of the apparatus which is shown in FIG. 1 comprises a first monitoring means which is a photoelectric detector 90 adjacent to the transfer station 82 between the conveyors 62 and 78, a second monitoring means including a photoelectric detector 88 which is adjacent to the transfer station between the conveyors 23 and 22, and a scanning device 89 having a shroud or baffle which constitutes a movable wall of the bin 77*a* above the inlet of the packing machine 54. The photoelectric detector 90 can transmit signals to an amplifier 91*a* forming part of an actuating circuit 91 which can energize the solenoid of the shutoff valve 92 so that this valve opens and enables the conveyor 61 to receive cigarettes 13 from the conveyor 22 of the switchover unit 1.

The photoelectric detector 88 has a light source which emits a beam of light against the periphery of the conveyor 22 whereby the photosensitive transducer of the detector 88 produces a signal whenever it detects a cigarette 13 in a flute 63 of the conveyor 22. The output of the transducer of the detector 88 is connected with a control circuit 94 which is shown in detail in FIG. 3. The control circuit 94 has another input which is connected with the scanning device 89 through the medium of an amplifier 96. The signal from the amplifier 96 can start the motor 81 for the last conveyor 76 of the main transporting unit 3. A first output of the control circuit 94 can start the motor 79 for the intermediate conveyor 78, and a further output of the control circuit 94 can start the motor 87 for the blocking conveyor 83.

Figure 3:
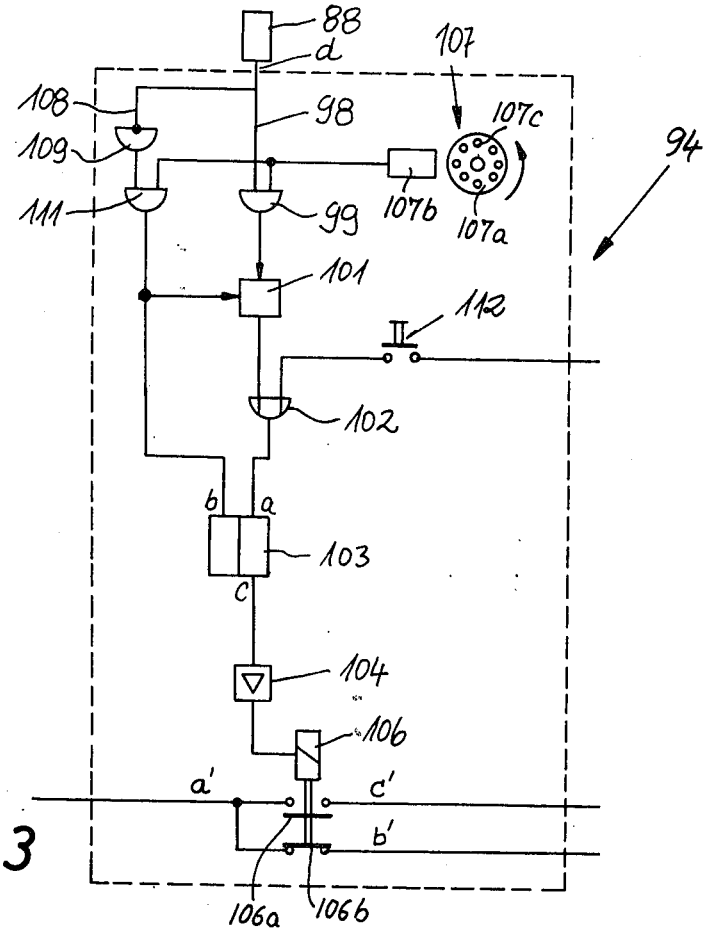
FIG. 3 is a diagram of a control circuit in the apparatus of FIG. 1.

Referring to FIG. 3, the control circuit 94 comprises a plurality of electronic and electrical components which establish a primary path 98 for the transmission of signals to the input *a* of a signal storing circuit 103 of the type known as flip-flop, and a secondary path 108 for the transmission of signals to the input *b* of the circuit 103. An input *d* of the control circuit 94 receives signals from the photoelectric detector 88, and such signals are transmitted to one input of an AND-gate 99. The output of the gate 99 is connected to one input of a counter 101 which has an output connected to one input of an OR-gate 102. The output of the OR-gate 102 is connected to the input *a* of the signal storing circuit 103. The output *c* of the circuit 103 is connected with the winding of a relay 106 by way of an amplifier 104. The other input of the AND-gate 99 is connected with the output of a timer 107 having a disk 107*a* which rotates in synchronism with the conveyor 22 and produces a signal whenever a cigarette 13 is received by a flute 63. The output of the timer 107 is further connected to one input of a second AND-gate 111 which is connected with a second input of the counter 101 and with the input *b* of the signal storing circuit 103. The other input of the AND-gate 111 is connected with the input *d* of the control circuit 94 by way of a NO-gate 109. The relay 106 has two switches 106*a* and 106*b*. When the switch 106*a* is closed, the relay 106 connects a conductor *a'* from the scanning device 89 with a conductor *c'* which is connected with the motor 87 for the blocking conveyor 83. When the switch 106*b* is closed, the relay 106 connects the conductor *a'* with a conductor *b'* which is connected with the motor 79 for the intermediate conveyor 78 of the main transporting unit 3.

The exact construction of the timer 107 forms no part of the invention. In the illustrated embodiment the timer comprises the aforementioned disk 107*a* which rotates with the conveyor 22 and a proximity detector 107*b* which transmits signals to the gates 99 and 111 whenever one of several holes 107*c* in the disk 107*a* permits a light beam to pass therethrough. The holes 107*c* in the disk 107*a* can be replaced by permanent magnets.

The detector 88 transmits to the AND-gate 99 signals when it fails to detect cigarettes 13 in the flutes 63 of the conveyor 22. If the timing of such signals coincides with timing of signals from the proximity detector 107*b* of the timer 107, the output of the AND-gate 99 transmits a signal to the counter 101. The counter 101 can be set in such a way that its output transmits a signal to the corresponding input of the OR-gate 102 when it receives a succession of, for example, ten signals. Thus, the counter 101 insures that the gate 102 cannot transmit a signal to the input *a* of the signal storing circuit 103 except when the detector 88 determines that the conveyor 22 has a series of successive flutes 63 which are not occupied by cigarettes 13. It can be assumed that the source 154 including the transfer conveyor 23 does not operate properly if the conveyor 23 fails to transfer cigarettes into ten successive flutes 63 of the conveyor 22. When the input *a* of the circuit 103 receives a signal from the OR-gate 102, its output *c* causes the amplifier 104 to energize the relay 106. The switch 106*a* then connects the conductor *a'* with the conductor *c'* so that the motor 87 for the blocking conveyor 83 is started. At the same time, the switch 106*b* interrupts the connection between the conductor *a'* and the conductor *b'* so that the motor 79 for the intermediate conveyor 78 of the main transporting unit 3 is arrested.

The secondary path 108 (including the gates 109 and 111) serves to reset the counter 101 to zero and to transmit signals to the erasing input *b* of the signal storing circuit 103. If a flute 63 which is scanned by the photoelectric detector 88 contains a cigarette 13, the output of the detector 88 does not transmit a signal to the NO-gate 109. The output of the gate 109 then transmits a signal to the corresponding input of the AND-gate 111. When the timing of such signal coincides with the timing of a signal from the proximity detector 107*b* to the AND-gate 111, the output of the gate 111 transmits erasing signals to the counter 101 and the input *b* of the circuit 103. The relay 106 is deenergized and the switches 106*a* and 106*b* reassume the positions shown in FIG. 3. Consequently, the motor 87 for the blocking conveyor 83 is arrested and the motor 79 for the intermediate conveyor 78 of the main transporting unit 3 is started again.

The second input of the OR-gate 102 is connected with a conductor which contains a master switch 112. When the master switch 112 is closed by hand, the input *a* of the signal storing circuit 103 receives a signal, the same as if the signal were to come from the counter 101, whereby the amplifier 104 energizes the relay 106 and the switches 106*a*, 106*b*, respectively, connect the conductors *a'*, *c'* and separate the conductors *a'*, *b'* from each other. Thus, by closing the master switch 112, the operator can stop the source 154 including the transfer conveyor 23. Since such stoppage of the source 154 entails the movement of switch 106*a* to its upper end position, the conductor *a'* is automatically connected with the conductor *c'* so that the blocking conveyor 83 is set in motion and enables cigarettes 13 to leave the chute 56 by way of the discharge end 59 and to descend onto the last conveyor 76 of the main transporting unit 3. The importance of such mode of operation will be readily appreciated if one considers that the source 154 can be arrested at the time when the detector 88 scans a flute 63 which contains a cigarette 13. In the absence of the master switch 112, the blocking conveyor 83 could not be started in spite of the fact that the source 154 is at a standstill.

The belt conveyor 62 can be said to constitute the third conveyor of the switchover unit 1 (the first transporting unit 3 then comprises only two conveyors 78, 76) or the first or foremost conveyor of the first transporting unit 3 (the switchover unit 1 then comprises the conveyors 61, 22). In the illustrated embodiment of the apparatus, the conveyors 22, 61, 62 or 22, 61 of the switchover unit 1 are located in a common vertical plane. If desired, the switchover unit can comprise more than three conveyors.

The scanning device 89 constitutes a means for arresting the motors 81, 79 for the conveyors 76, 78 when the bin 77*a* accumulates a predetermined supply of cigarettes 13 at the inlet of the packing machine 54 as a result of failure of the machine 54 to accept cigarettes from the transporting unit 3 at the rate at which the unit 3 receives cigarettes from the source 154 through the medium of the switchover unit 1. The motor 87 for the blocking conveyor 83 is started in response to signals from the detector 88. This detector also starts the motor 79 for the intermediate conveyor 78.

The operation of the apparatus is as follows:

It is assumed that the source 154 is in operation so that the transfer conveyor 23 delivers filter cigarettes 13 into successive flutes 63 of the conveyor 22. It is further assumed that the packing machine 54 operates properly. Therefore, the shutoff valve 92 in the suction pipe 72 is closed and the conveyor 61 of the switchover unit 1 cannot accept cigarettes from the conveyor 22. Consequently, the flutes 63 of the conveyor 22 deliver filter cigarettes 13 onto the upper stretches of the belt conveyors 62 forming the first conveyor of the main transporting unit 3. The transfer of cigarettes from the flutes 63 onto the upper stretches of the conveyors 62 presents no problems because the groove 68 of the valve plate 68*a* terminates at the locus or in the general area where a cigarette 13 which occupies a flute 63 approaches the upper stretches of the conveyors 62. Therefore, such transfer does not result in damage and/or deformation of cigarettes.

The upper stretches of the conveyors 62 transport a single file of cigarettes 13 sideways toward the transfer station 82 which is monitored by the photoelectric detector 90. Since the speed of the upper stretch of the intermediate conveyor 78 is less than the speed of the conveyors 62, the cigarettes 13 which advance beyond the conveyors 62 form on the conveyor 78 a stream 97 which consists of several superimposed layers, for example, four, five or more layers. The stream 97 advances beyond the intermediate conveyor 78 and with the last conveyor 76 to enter the bin 77*a* from which the cigarettes enter the ducts of the block forming device 77 to be converted into groups which are introduced into the packing machine 54. Thus, when the machines 154, 54 operate properly, the packing machine 54 processes the entire output of the filter cigarette making machine (source 154).

It is now assumed that the operating speed (rate of consumption) of the packing machine 54 is reduced or that the packing machine is arrested due to a malfunction. Consequently, the aforementioned pusher does not remove groups of cigarettes from the ducts of the block forming device 77 so that the cigarettes which are being delivered by the main transporting unit 3 accumulate in the bin 77*a* and displace the baffle of the scanning device 89. The resulting signal from the scanning device 89 is amplified at 96 and is used to arrest the motor 81 for the last conveyor 76. Such signal is further transmitted to the corresponding input of the control circuit 94 (see the conductor *a'* in FIG. 3). At the same time, the signal from the scanning device 89 arrests the motor 79 for the intermediate conveyor 78, either directly from the output of the amplifier 96 or through the control circuit 94 in a manner as described in connection with FIG. 3. Since the source 154 continues to deliver cigarettes 13 into the flutes of the conveyor 22, the conveyors 62 deliver cigarettes to the transfer station 82 where the cigarettes pile up and cause the detector 90 of the actuating circuit 91 to transmit a signal whereby the amplifier 91*a* opens the shutoff valve 92 so that the suction pipe 72 connects the groove 69 of the valve plate 69*a* with the suction generating device 93. Consequently, the flutes 64 of the conveyor 61 begin to receive cigarettes 13 from the flutes 63 of the conveyor 22, and such cigarettes enter the upwardly inclined portion of the second path between the endless belt conveyors 14 and 16 to advance into the arcuate portion of the second path between the drum 6 and the belt conveyors 7. The cigarettes 13 enter the magazine 2 by way of the inlet 29 and exert pressure against the pivotable end wall 36 which forms part of the detector 34. The chute 56 is filled with cigarettes 13 and the discharge end 59 maintains a supply of cigarettes on the upper stretch of the blocking conveyor 83. The gate 84 cooperates with the ramp 86 to prevent escape of cigarettes 13 from the discharge end 59 onto the last conveyor 76 of the main transporting unit 3. When the end wall 36 actuates the limit switch 46 of the detector 34, the electronic relay 47 receives a signal which is transmitted to the rotary electromagnet 48 whereby the belt or chain 49 drives the pulley 39 in a direction to move the end wall 38 away from the end wall 36 of the magazine 2. Consequently, the volume of the magazine 2 increases so that the magazine can accept and store cigarettes 13 which are being supplied by the feeding device 33. The movement of the end wall 38 away from the end wall 36 is automatically terminated and the moving parts of the source 154 are arrested when the end wall 38 actuates the limit switch 51.

If the packing machine 54 is restarted before the end wall 38 reaches the limit switch 51, the supply of cigarettes in the bin 77*a* decreases because the block forming device 77 removes groups of cigarettes from the bin so that the scanning device 89 reassumes its normal position and permits a starting of the motors 81 and 79 with the result that the conveyors 76 and 78 of the main transporting unit 3 are set in motion. The conveyors 62 are continuously driven so that they can begin to supply cigarettes to the intermediate conveyor 78 as soon as the shutoff valve 92 is closed, i.e., as soon as the switchover unit 1 begins to deliver cigarettes 13 to the main transporting unit 3. The detector 90 detects that the supply of cigarettes 13 at the transfer station 82 decreases because the surplus of cigarettes is removed by the conveyors 78 and 76. The actuating circuit 91 then closes the shutoff valve 92 and the flutes 63 of the conveyor 22 again deliver cigarettes onto the conveyors 62 instead of into the flutes 63 of the conveyor 61.

It is now assumed that the source 154 including the transfer conveyor 23 is arrested so that the flutes 63 cease to receive cigarettes 13 from the flutes 23*a* of the conveyor 23. The absence of cigarettes 13 in the flutes 63 is detected by the detector 88 which transmits signals to the AND-gate 99 of FIG. 3 in the previously described manner, and the counter 101 transmits a signal to the input *a* of the signal storing circuit 103 as soon as the detector 88 detects the absence of 10 successive cigarettes 13. The relay 106 is then energized and its switch 106*a* connects the conductor *a'* with the conductor *c'* so that the motor 87 for the blocking conveyor 83 is started. At the same time, the conductor *a'* is disconnected from the conductor *b'* so that the motor 79 for the intermediate conveyor 78 of the main transporting unit 3 is arrested. The last conveyor 76 continues to deliver cigarettes of the foremost portion of the stream 97 into the bin 77*a* from which the cigarettes are removed in groups by the block forming device 77 for introduction into the inlet of the packing machine 64. When the height of the stream 97 at a level below the left-hand pulley for the blocking conveyor 83 decreases, the ramp 86 is free to pivot counterclockwise, as viewed in FIG. 1, because its lower edge rests on the uppermost layer of cigarettes of the stream 97, whereby the ramp 86 moves away from the pivotable gate 84 so as to open a passage for the flow of cigarettes 13 from the discharge end 59 of the chute 56 onto the moving conveyor 76 of the main transporting unit 3. The ramp 86 actually descends into a depression or recess in the stream 97 of cigarettes 13 between the conveyors 76 and 78. The gate 84 cannot follow the pivotal movement of the ramp 86 because the blocking conveyor 83 is in motion so that the cigarettes on the upper stretch of this conveyor exert a pressure against and tend to pivot the gate 84 in a clockwise direction, as viewed in FIG. 1. Consequently, the cigarettes in the chute 56 descend toward and through the discharge end 59 and onto the moving conveyor 76 to be transported into the bin 77*a* and thence into the inlet of the packing machine 54.

As the cigarettes 13 leave the magazine 2 by way of the outlet 31, the pressure upon the end wall 36 decreases so that this end wall pivots counterclockwise, as viewed in FIG. 1, under the action of the aforementioned weak spring whereby the end walll 36 actuates the limit switch 44 which transmits a signal to the electronic relay 47. The latter starts the electromagnet 48 in a direction to move the end wall 38 toward the end wall 36, i.e., to reduce the volume or capacity of the magazine 2. The packing machine 54 is arrested when the trip 53 on the upper stretch of the belt conveyor 32 engages the limit switch 52. On the other hand, the moving parts of the source 154 are automatically arrested when the end wall 38 engages and actuates the limit switch 51. The capacity of the magazine 2 is preferably selected in such a way that its interior can store a substantial supply of cigarettes 13, namely a supply which accumulates if the packing machine 54 is arrested for a relatively short period of time while the source 154 continues to supply cigarettes to the conveyor 22, or to supply the packing machine 54 with cigarettes 13 for a relatively short interval of time which is necessary to carry out minor repairs on the source 154.

An advantage of the improved apparatus is that the source 154 need not be arrested simultaneously with the packing machine 54 if the packing machine is out of commission, or that the packing machine 154 need not be arrested in immediate response to stoppage of the moving parts of the source 154. This contributes to a higher output of the production line which includes the machine 54 and source 154. The chute 56 can be designed and dimensioned in such a way that it can also store a substantial supply of cigarettes which, when added to the maximum capacity of the magazine 2, suffices to satisfy the requirements of the packing machine 54 for a certain interval of time when the source 154 is idle, or to accept the output of the source 154 for a certain interval of time while the packing machine 54 is idle.

Another advantage of the improved apparatus is that the conveyors of its switchover unit can direct articles into the first or second path without any damage to and/or without any appreciable deformation of articles. The shifting from delivery into the first path to delivery into the second path is smooth and practically instantaneous.

An advantage of the mounting of magazine 2 at a level above the first path and of such construction of the second transporting unit 4, 33, 56 that the inlet 29 receives cigarettes from above is that the cigarettes 13 which are close to or at the discharge end of the arcuate portion of the second path can enter the magazine by gravity as well as that the cigarettes can leave the magazine by gravity flow. This reduces the likelihood of damage to cigarettes during entry into and evacuation from the magazine 2.

It is also possible to replace the automatic actuating circuit 91 for the switchover unit 1 with manual actuating means. However, the automatic actuation of switchover unit 1 is preferred at this time because the operation of the apparatus need not be constantly supervised, i.e. the attendant or attendants need not be on constant alert in order to determine whether or not the rate at which the source 154 supplies cigarettes 13 exceeds the rate at which the packing machine 54 accepts cigarettes or vice versa. The utilization of monitoring means in the form of photoelectric detectors also contributes to simplicity and reliability of the regulating operation. Such detectors can be readily replaced in the event of malfunction whereby the replacement takes up a negligible amount of time.

A first transporting unit which consists of several discrete conveyors (62, 78, 76) each of which defines a discrete portion of the first path between the source 154 and the packing machine 54 and each of which can be driven by a separate prime mover (22, 79, 81) exhibits the advantage that the single row of cigarettes 13 which issue from the source 154 can be converted into a multi-layer stream 97 wherein the cigarettes 13 are much less likely to become misaligned during sidewise movement toward and into the bin 77*a* at the inlet of the packing machine 54. The cigarettes 13 which form the stream 97 support and guide each other to thereby insure an exact alignment of all cigarettes which reach the bin. Thus, and since it is desirable to convert the single row of cigarettes 13 which are supplied by the source 154 into a multi-layer stream as soon as possible, the deceleration of cigarettes in the first path preferably takes place as close to the switchover unit 1 as possible, i.e., at the transfer station 82 between the first and second conveyors 62, 78 of the first transporting unit 3. This reduces the likelihood of misalignment of cigarettes during movement along the major portion of the first path.

The feature that the speed of the blocking conveyor 83 (when the latter is driven by the motor 87) equals of approximates the speed of the last conveyor 76 of the first transporting unit 3 exhibits the advantage that the cigarettes 13 which travel from the discharge end 59 of the chute 56 (this is also the discharge end of the second path) are less likely to be damaged during transfer onto the conveyor 76. As mentioned before, the third path which is defined by the upper stretch of the blocking conveyor 83 is preferably parallel or nearly parallel to that portion of the first path wherein the cigarettes 13 must travel during movement from the discharge end 59 toward the bin 77*a*. The scanning device 89 insures that the motor 87 for the blocking conveyor 83 is arrested as soon as the quantity of cigarettes 13 in the bin 77*a* exceeds a predetermined value i.e., as soon as the packing machine 54 is incapable of accepting all cigarettes 13 which are being evacuated from the second path via discharge end 59 and conveyor 83.

Without further analysis, the foregoing will so fully reveal the gist of the present invention that others can, by applying current knowledge, readily adapt it for various applications without omitting features which fairly constitute essential characteristics of the generic or specific aspects of our contribution to the art and, therefore, such adaptations should and are intended to be comprehended within the meaning and range of equivalence of the claims.

What is claimed as new and desired to be protected by Letters Patent is set forth in the appended claims.

1. Apparatus for effecting and regulating the delivery of rod-shaped articles from a source which supplies articles at a first variable rate to a consumer which accepts articles at a second variable rate, particularly for effecting and regulating the delivery of smokers' products from a producing machine to a consuming machine, comprising first transporting means for moving articles from said source directly to said consumer along a first path; second transporting means for moving articles from said source to said consumer along a second path; switchover means actuatable to direct articles from said source into a selected path; a variable-volume magazine communicating with said second path; and means for changing the volume of said magazine in response to changes in the proportion of said rates so that the volume of said magazine increases and the magazine receives articles from said second path when said first rate exceeds said second rate and said volume decreases whereby said magazine feeds articles into said second path when said second rate exceeds said first rate.

2. Apparatus as defined in claim 1, wherein said switchover means comprises a plurality of conveyors.

3. Apparatus as defined in claim 2, wherein said conveyors are located in a common vertical plane.

4. Apparatus as defined in claim 2, wherein said conveyors include a first conveyor which receives articles from said source, a second conveyor arranged to transfer articles from said conveyor into one of said paths, and a third conveyor actuatable to transfer articles from said first conveyor into the other of said paths, said switchover means further comprising means for selectively actuating said third conveyor.

5. Apparatus as defined in claim 1, wherein said magazine is located at a level above said first path.

6. Apparatus as defined in claim 5, wherein said second path includes a substantially vertical portion having a lower end adjacent to said switchover means and said second transporting means comprises a pair of conveyors flanking said vertical portion and arranged to transport articles toward said magazine when said switchover means is actuated to direct articles from said source into said second path.

7. Apparatus as defined in claim 6, wherein said switchover means comprises means for conveying articles from said source into the range of said conveyors of said second transporting means.

8. Apparatus as defined in claim 1, wherein said switchover means comprises conveyor means arranged to normally direct articles from said source into said first path and being actuatable to direct articles from said source into said second path, and actuating means for said conveyor means, said actuating means comprising means for monitoring the movement of articles along said first path.

9. Apparatus as defined in claim 8, wherein said monitoring means comprises a photoelectric detector.

10. Apparatus as defined in claim 1, wherein said first transporting means comprises a plurality of discrete conveyors each arrangned to move articles along a different portion of said first path.

11. Apparatus as defined in claim 10, wherein said first transporting means comprises discrete prime movers for at least two of said plurality of conveyors.

12. Apparatus as defined in claim 1, wherein said first transporting means comprises at least two discrete conveyors each arranged to move articles along a different portion of said first path and means for driving said conveyors at different speeds.

13. Apparatus as defined in claim 12, wherein one of said conveyors is adjacent to and normally receives articles from said switchover means and the other of said conveyors receives articles from said one conveyor, the speed of said one conveyor exceeding the speed of said other conveyor.

14. Apparatus as defined in claim 13, wherein said one conveyor delivers articles to said other conveyor at a predetermined transfer station and said switchover means comprises additional means which normally directs articles from said source to said one conveyor and is actuatable to direct articles from said source into said second path, said switchover means further comprising means for actuating said additional conveyor means including means for monitoring the movement of articles at said transfer station and for effecting the transport of articles from said source into said second path in response to accumulation of a predetermined supply of articles at said transfer station when said first rate exceeds said second rate.

15. Apparatus as defined in claim 1, wherein switch switchover means normally directs articles from said source into said first path and said switchover means comprises a conveyor which is actuatable to direct articles from said source into said second path, said switchover means further comprising means for actuating said conveyor including means for monitoring a portion of said first path for accumulations of articles therein when said first rate exceeds said second rate and for effecting the actuation of said conveyor in response to detection of an accumulation of a predetermined supply of articles in said portion of said first path.

16. Apparatus as defined in claim 15, wherein said conveyor of said switchover means is a rotary suction conveyor and said actuating means further comprises a suction generating device and means for connecting said suction generating device to said rotary conveyor in response to a signal which is furnished by said monitoring means as a result of accumulation of said predetermined supply of articles.

17. Apparatus as defined in claim 1, wherein said first transporting means comprises a plurality of discrete conveyors each arranged to move articles along a different portion of said first path, said conveyors including a last conveyor arranged to deliver articles to said consuming machine, said consuming machine having an inlet and further comprising means for arresting at least said last conveyor of said first transporting means in response to accumulation of articles at said inlet.

18. Apparatus as defined in claim 1, further comprising a bin disposed at the inlet of said consuming machine, said arresting means including means for scanning the quantity of articles in said bin and for terminating the operation of said last conveyor when said bin accumulates a predetermined supply of articles at said inlet as a result of failure of said consumer to accept articles from said first transporting unit at the rate at which said first transporting unit receives articles from said source.

19. Apparatus as defined in claim 1, wherein said magazine has an outlet located at a level above a portion of said first path.

20. Apparatus as defined in claim 1, wherein said second path has a discharge end for delivery of articles into said first path intermediate said switchover means and said consumer, said magazine having an outlet communicating with said second path upstream of said discharge end, as considered in the direction of movement of articles along said second path, and further comprising means for blocking the movement of articles from said discharge end into said first path when said switchover means directs articles into said first path.

21. Apparatus as defined in claim 20, wherein said blocking means comprises a conveyor which is idle while said switchover means directs articles into said first path.

22. Apparatus as defined in claim 21, wherein said conveyor defines for articles leaving said discharge end a third path which is parallel to the neighboring portion of said first path.

23. Apparatus as defined in claim 1, wherein said first transporting means comprises a plurality of discrete conveyors each arranged to move articles along a different portion of said first path, said conveyors including a last conveyor which is adjacent to said consumer and said second path having a discharge end adjacent to that portion of said first path which is defined by said last conveyor of said first transporting means.

24. Apparatus as defined in claim 23, wherein said discharge end is located at a level above said last conveyor.

25. Apparatus as defined in claim 23, further comprising means for blocking the movement of articles from said discharge end onto said last conveyor, said blocking means comprising a further conveyor which is idle when said switchover means directs articles into said first path and motor means for moving said further conveyor at the speed of said last conveyor.

26. Apparatus as defined in claim 25, wherein said switchover means comprises additional conveyor means for transporting articles into one of said paths and further comprising means for starting said motor means, including means for monitoring said additional conveyor means for the presence or absence of articles.

27. Apparatus as defined in claim 26, wherein said monitoring means comprises a photoelectric detector.

28. Apparatus as defined in claim 26, wherein said consumer comprises an inlet and further comprising means for arresting said motor means in response to excessive accumulation of articles at said inlet.

29. Apparatus as defined in claim 28, further comprising a bin for articles at said inlet, said arresting means comprising a device for scanning said bin for the quantity of articles therein.

30. Apparatus as defined in claim 1, wherein said consumer has an inlet and said first transporting means comprises a plurality of conveyors each arranged to move articles along a different portion of said first path, said conveyors including a first conveyor adjacent to said switchover means, a last conveyor adjacent to said inlet, and an intermediate conveyor between said first and last conveyors, said first transporting means further comprising discrete motor means for said intermediate conveyor and means for arresting said motor means in response to excessive accumulation of articles at said inlet.

31. Apparatus as defined in claim 30, further comprising a bin for articles at said inlet, said arresting means comprising a device for scanning the quantity of articles in said bin.

32. Apparatus as defined in claim 30, wherein said switchover means comprises an additional conveyor arranged to normally deliver articles from said source to said first conveyor of said first transporting means, and further comprising means for starting said motor means including means for monitoring said additional conveyor for the presence or absence of articles.

33. Apparatus as defined in claim 32, wherein said monitoring means comprises a photoelectric detector arranged to initiate the starting of said motor means in response to delivery of articles from said source to said additional conveyor and while said switchover means directs articles into said first path.

34. Apparatus as defined in claim 1, wherein said consumer has an inlet and said first transporting means comprises a plurality of discrete conveyors including a last conveyor arranged to deliver articles to said inlet and a second conveyor arranged to deliver articles to said last conveyor, said first transporting means further comprising discrete first and second motors for said last and second cnveyors, said second path having a discharge end in the region of one of said conveyors and further comprising a third conveyor arranged to normally block the transfer of articles from said discharge end to said one conveyor of said first transporting means and a third motor for said third conveyor, and control means for said motors including means for scanning said inlet for accumulation of articles and means for monitoring said switchover means for the presence or absence of articles.

35. Apparatus as defined in claim 1, wherein said switchover means comprises a rotary drum-shaped first conveyor having a peripheral surface provided with article-receiving flutes parallel to the axis of said first conveyor and at least one additional conveyor for feeding articles into the flutes of said first conveyor when said switchover means is actuated to direct articles into said second path, and further comprising means for retaining articles in said flutes during transport from said additional conveyor into said second path in actuated condition of said switchover means.

36. Apparatus as defined in claim 35, wherein said retaining means comprises suction ports provided in said first conveyor and communicating with said flutes, a suction generating device, and means for connecting said suction generating device with the ports for those flutes which contain articles and travel from the locus of delivery of articles from said additional conveyor to said first conveyor to the locus where said flutes deliver articles into said second path.

37. Apparatus as defined in claim 1, wherein said switchover means comprises a rotary drum-shaped conveyor which is actuatable to direct articles into said second path and has a peripheral surface provided with article-receiving flutes extending in parallelism with the axis of said conveyor, said conveyor further having at least one guide means located in a plane normal to said flutes and second transfer means comprising at least one endless flexible conveyor having a first portion trained over said guide means and a second portion flanking that portion of said second path which is immediately adjacent to said switchover means.

38. Apparatus as defined in claim 37, wherein said rotary conveyor has two guide means and said second transfer means comprises two endless flexible conveyors having first portions trained over discrete guide means of said rotary conveyor and second portions adjacent to said portion of said second path.

39. Apparatus as defined in claim 37, wherein said guide means comprises an endless groove provided in said peripheral surface.

40. Apparatus as defined in claim 39, wherein the depth of said groove, as considered radially of said rotary conveyor, is such that said first portion of said flexible element is located radially inwardly of the deepmost portions of said flutes.

41. Apparatus as defined in claim 1, wherein said switchover means comprises a rotary drum-shaped conveyor arranged to normally direct articles from said source into said first path and said first transporting means comprises a plurality of discrete conveyors each arranged to move articles along a different portion of said first path, said plurality of conveyors including a first conveyor having at least one endless flexible conveying element trained over said rotary conveyor of said switchover means.

42. Apparatus as defined in claim 41, wherein said rotary conveyor has a peripheral surface provided with article-receiving flutes parallel to the axis of said rotary conveyor and a circumferential groove for a portion of said conveying element, said portion of said conveying element being located inwardly of said flutes, as considered in the radial direction of said rotary conveyor.

43. Apparatus as defined in claim 1, wherein said switchover means comprises a rotary conveyor arranged to normally transport articles from a first locus where said conveyor receives articles from said source to a second locus where said conveyor delivers articles into said first path, and means for holding articles by suction between said first and second loci.

44. Apparatus as defined in claim 43, wherein said switchover means further comprises a second rotary conveyor arranged to transport articles from said second locus into said second path when said switchover means is actuated and means for retaining articles on said second rotary conveyor by suction between said second locus and a third locus where said second rotary conveyor delivers articles into said second path.

45. Apparatus as defined in claim 44, wherein said second rotary conveyor has a peripheral surface provided with article-receiving flutes extending in parallelism with the axis of said second conveyor, said retaining means comprising suction ports provided in said second conveyor and extending inwardly from said flutes, a suction generating device, and means for connecting said suction generating device with the ports which are located between said second and third loci in response to a pileup of articles in said first path.

* * * * *

UNITED STATES PATENT OFFICE

CERTIFICATE OF CORRECTION

PATENT NO. : 3,952,854

DATED : April 27, 1976

INVENTOR(S) : Fritz Selonke and Ulrich Bornfleth

It is certified that error appears in the above-identified patent and that said Letters Patent are hereby corrected as shown below:

Col. 1, line 60, "liklihood" should read --likelihood--.

Col. 2, lines 20 and 27, "liklihood" should read --likelihood--
line 28, "which" should be omitted.

Col. 3, line 31, "articles." should read --articles).--.

Col. 5, line 5, "belt chain" should read --belt or chain--.

Col. 6, line 7, "at" should read --that--;
line 58, "FIGS." should read --FIG.--.

Col. 7, line 46, "conveyor" should read --conveyors--;
line 61, "62," should read --62),--.

Col. 11, line 32, --to-- should be inserted after "damage".

Claim 4, line 4, "said conveyor" should read --said first conveyor--.

Claim 10, line 3, "arrangned" should read --arranged--.

Claim 14, line 4, "additional means" should read --additional conveyor means--.

Claim 15, line 1, "switch" should read --said--.

Signed and Sealed this

Thirty-first Day of August 1976

[SEAL]

*Attest:*

RUTH C. MASON
*Attesting Officer*

C. MARSHALL DANN
*Commissioner of Patents and Trademarks*